United States Patent [19]

Johnson

[11] 4,185,611

[45] * Jan. 29, 1980

[54] FIREPLACE HEATING UNIT

[76] Inventor: John Johnson, 3695 Hunter St., Glen Avon, Calif. 92509

[ * ] Notice: The portion of the term of this patent subsequent to May 9, 1995, has been disclaimed.

[21] Appl. No.: 889,754

[22] Filed: Mar. 24, 1978

Related U.S. Application Data

[63] Continuation-in-part of Ser. No. 713,888, Aug. 12, 1976, Pat. No. 4,088,114.

[51] Int. Cl.[2] ..... F24B 7/00

[52] U.S. Cl. ..... 126/121; 126/164

[58] Field of Search ..... 126/121, 122, 125, 130, 126/131, 137, 141, 164, 165, 143; 237/51, 55

[56] References Cited

U.S. PATENT DOCUMENTS

| | | | |
|---|---|---|---|
| 59,620 | 11/1866 | McCleary | 126/141 |
| 831,096 | 9/1906 | Posey | 126/137 |
| 1,313,085 | 8/1919 | Greene | 126/121 |
| 2,052,643 | 9/1936 | Modine | 126/121 |
| 3,911,894 | 10/1975 | Richard, Jr. et al. | 126/121 |
| 3,942,509 | 3/1976 | Sasser | 126/164 |
| 4,008,703 | 2/1977 | Allgood | 126/121 |
| 4,010,729 | 3/1977 | Egli | 126/121 |
| 4,018,209 | 4/1977 | Bonuicini | 126/121 |

FOREIGN PATENT DOCUMENTS

| | | | |
|---|---|---|---|
| 24575 | of 1910 | United Kingdom | 126/165 |
| 556543 | 10/1943 | United Kingdom | 126/121 |
| 651856 | 4/1951 | United Kingdom | 126/143 |

*Primary Examiner*—Carroll B. Dority, Jr.
*Assistant Examiner*—Lee E. Barrett
*Attorney, Agent, or Firm*—Knobbe, Martens, Olson, Hubbard & Bear

[57] ABSTRACT

A fireplace heating unit comprises a continuous network of hollow tubular members situated in a fireplace. The tubular members absorb heat from the fireplace while air propelled by suitable air moving means passes through the tubular members absorbing heat therefrom. A portion of the air passing through the tubular members may be directed so as to impinge upon the flame in the fireplace and means are provided to control the direction and quantity of the flame-impinging air flow. The remaining air which is not directed onto the flame continues its passage through the tubular members and exits either directly into the room or into a device, such as an oven, for heating other objects. The invention is adaptable for use with either coal or wood fires and in one embodiment is adaptable for use in fireplaces which use a gas jet flame.

22 Claims, 12 Drawing Figures

FIG. 1.
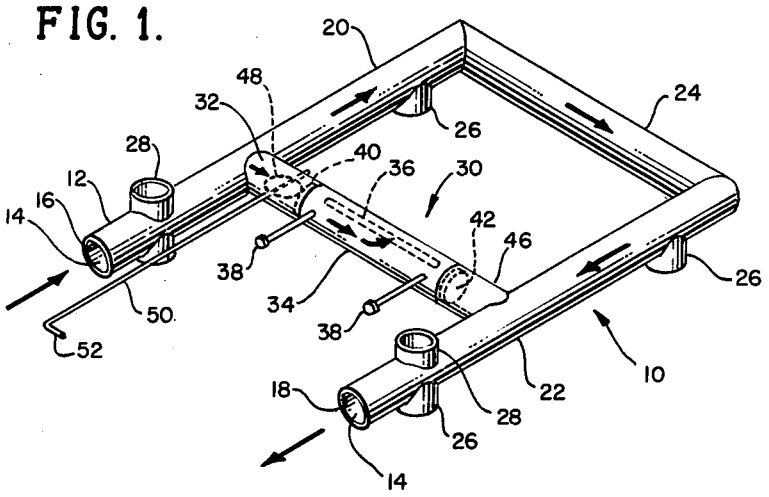
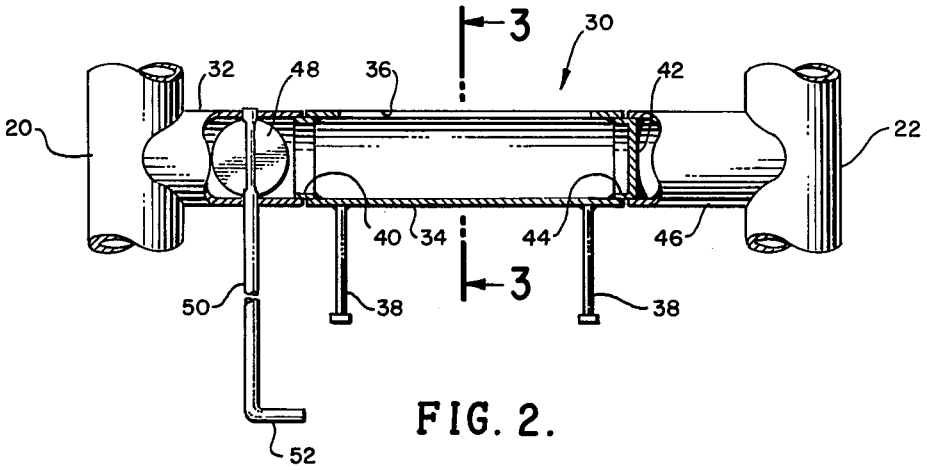
FIG. 2.
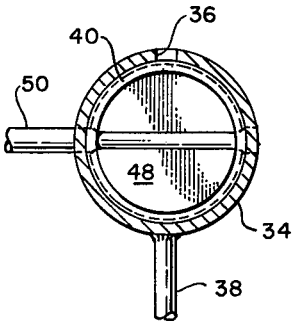
FIG. 3A.
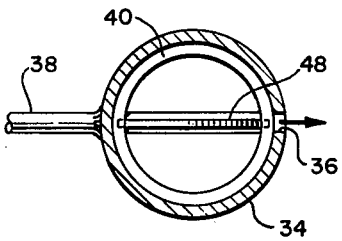
FIG. 3B.
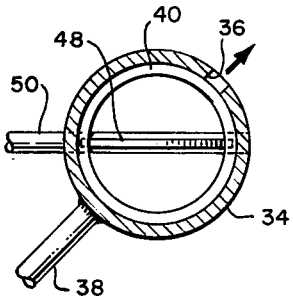
FIG. 3C.

FIREPLACE HEATING UNIT

CROSS-REFERENCE TO RELATED APPLICATION

This is a continuation-in-part of co-pending Application Ser. No. 713,888 filed Aug. 12, 1976, now U.S. Pat. No. 4,088,114.

BACKGROUND OF THE INVENTION

This invention relates to air heating devices which utilize the heat generated in a fireplace.

In the typical fireplace, most of the heat rises up and escapes through the chimney and relatively little heat is retrievable in usable form. The products of combustion are in part poisonous and are virtually impossible to separate from the heated air. Thus, safety factors dictate that the heated air be diverted up to the chimney with the products of combustion. As a result, there has long been sought a means for improving the heating efficiency of fireplaces while, at the same time, providing for adequate ventilation of the combustion products. A method of achieving this goal which has met with some degree of popularity is to conduct a quantity of air from a source external to the fireplace, such as the room, through one or more heat absorbing conduits in the fireplace. The air absorbs heat from the fireplace as it passes through the conduits and then flows into the room raising the temperature of the ambient air. The prior art shows several devices built in accordance with this principle. However, several problems have arisen with respect to these prior art devices. For example, in many such devices, the configuration of the air flow conduits is such that areas of stagnation develop within the conduits, thereby inhibiting the flow of air therethrough. Other prior art devices have the air flow conduits disposed beneath the fuel retaining grate so that heat absorption is by means of radiation alone, and not by a combination of radiation and conduction. In still other prior art devices, the arrangement of air flow conduits is such that the area of maximum heat concentration, i.e., the area of rising hot air immediately above the flame, is not utilized or is at best inadequately utilized for heating purposes.

An important consideration in fireplace design is to provide an adequate draft of air onto the fuel so as to facilitate both the initial ignition of the flame and the continued burning of the flame so as to consume the fuel as completely as possible without the need continually to restart the flame due to a tendency for the fire to suffocate from its own ashes. The prior art fireplace heaters do little or nothing to aid in providing such a draft and, in fact, their structure more likely has a tendency to inhibit the flow of air to the fuel. In those instances where the prior art does attempt to provide such draft, no means are provided for controlling the direction and volume of the flow of the draft so as to accommodate varying heating requirements and different kinds and amounts of fuel.

SUMMARY OF THE INVENTION

The present invention relates to a fireplace heater wherein ambient air is conducted into a fireplace where it absorbs heat, and then is conducted either back into the room, or into an appliance, such as an oven, which may utilize the heat absorbed by the air from the fireplace. By this means the invention improves the heating efficiency of the fireplace by increasing the amount of usable heat obtained therefrom and by decreasing the loss of heat through the chimney.

The invention comprises an air-conducting conduit having an internal wall and an entrance opening and exit opening and a heat absorbing portion between the entrance opening and the exit opening with an air passage through the conduit from the entrance or inlet opening to the exit or outlet opening, the air passage being enclosed by the internal wall of the conduit. Air moving means are provided for moving air through the air passage of the conduit. A portion of the air-conducting conduit in communication with the heat absorbing portion is provided with a slot passing through both the external and internal walls of the conduit so as to form an air jet passage to permit a jet of air to impinge upon the fuel to insure the proper drafting of the flame so as to facilitate the starting of a fire and to maintain the combustion of the fuel. This air jet portion of the air-conducting conduit is rotatable along a horizontal axis so that the direction of the air jet may be adjusted to accommodate different types and amounts of fuel. The air passage between the heat absorbing portion of the conduit and the air jet portion is provided with a damper so that the quantity of air flowing into the air jet portion may be adjusted, thereby permitting the intensity of the flame to be increased or decreased.

In the preferred embodiment of the invention, the air conducting conduit has a bottom portion which is formed so as to provide a grate for the fuel. This bottom portion forms a first heat-absorbing portion and is in air-flow communication with a second heat-absorbing portion extending into the area above the fuel. This second heat-absorbing portion is thus in the area which is above the flame in the fireplace, which is the area of rising hot air from the flame and therefore is the area of greatest heat concentration. In this embodiment, the air passage of the air-conducting conduit extends from the entrance opening through the first lower absorbing portion and then to the second upper heat-absorbing portion and finally to the exit opening.

Another embodiment of the invention is particularly advantageous for use in fireplaces which communicate with two adjoining rooms. In this embodiment, the air-conducting conduit has a base portion having a front side and a back side with the entrance opening and one exit opening on the front side and a second exit opening on the back side catercorner from the entrance opening. The air-conducting conduit has transverse heat-absorbing portions traversing both the front and back sides.

BRIEF DESCRIPTION OF THE DRAWINGS

FIG. 1 is a top perspective view of the embodiment of the invention employing only a lower heat-absorbing portion;

FIG. 2 is a fragmentary view, partially in section, of the air jet portion of the invention showing the details of the air flow controls;

FIGS. 3A, 3B, and 3C are cross-sectional views taken along line 3—3 of FIG. 2 showing various positions of the air flow control;

DETAILED DESCRIPTION OF THE INVENTION

Figure 4:
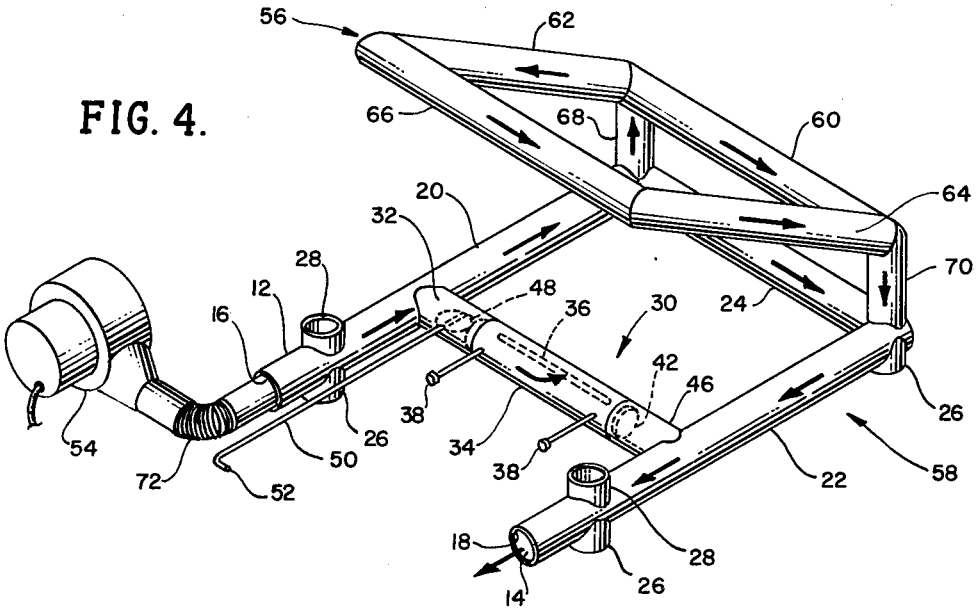
FIG. 4 is a top perspective view of the preferred embodiment of the invention showing the employment of air-moving means.

Referring now to the drawings, FIG. 1 shows the simplest embodiment of the invention. A fireplace heater 10 is comprised of an air-conducting conduit 12, the interior wall of which forms an air passage 14. The conduit 12 has an inlet or entrance opening 16 and an outlet or exit opening 18 which are located at the front of the fireplace. The conduit 12 comprises a first leg 20 extending longitudinally from the inlet opening 16 rearwardly into the fireplace, a second longitudinal leg 22 extending forwardly from the rear of the fireplace to the outlet opening 18, and a transverse leg 24 extending across the rear of the fireplace and connecting the rearmost extremities of the longitudinal legs 20 and 22. These legs 20, 22, and 24 form the heat-absorbing portion of the fireplace heater 10. The fireplace heater 10 is advantageously supported in the fireplace on a plurality of support members 26, preferably disposed proximate each corner of the heater. It is also advantageous to provide a pair of log-support members 28 extending upwardly from the longitudinal legs 20 and 22 proximate the inlet opening 16 and the outlet opening 18. An air jet portion 30, which will be presently described in detail, is disposed transversely between the legs 20 and 22 somewhat to the rear of the log-support members 28. In this configuration the fireplace heater 10 has the form of a grate for holding the log or other fuel for the fireplace.

The air jet portion 30 is shown most clearly in FIG. 2. As shown, the air jet portion 30 comprises a hollow tubular section 32, the inlet end of which is fixed to and in air-flow communication with the leg 20. The other end of the fixed tubular section 32 communicates with a hollow tubular center section 34 which is rotatable about its longitudinal axis. This center section 34 is provided with a longitudinal air jet outlet slot or openings 36. Diametrically opposed to the slot 36 and affixed to the exterior surface of the central tubular section 34 are one or more handles 38 which permit the rotatable center section 34 to be rotated by a fireplace poker or other suitable implement. The center section 34 is pivotally attached to the fixed tubular section 32 by means of a cylindrical boss 40, the exterior surface of which mates with the interior surface of the tubular section 32. The opposite end of the rotatable center section 34 is sealed with a cap member 42 which is fixed to the interior surface of the rotatable center section 34 and extends outwardly therefrom. The portion of the cap member 42 which protrudes from the rotatable center section 34 forms a cylindrical neck 44, the exterior surface of which has a snug rotating fit with the interior surface of a second fixed tubular section 46 which is fixed at a right angle to the leg 22. By sealing the center section 34, the cap member 42 prevents ashes, sparks, and other residue from the burning fuel which may fall through the slot 36, from being blown into the leg 22 and into the room or appliance to be heated.

The interior of the fixed tubular section 32 is provided with a damper 48 which is rotatable about an axis which is normal to the longitudinal axis of the tubular section 32. The damper 48 is turned so as to open or close the interior of the tubular section 32 by means of a pivot handle 50, which traverses the interior of the tubular section 32 along the axis of rotation of the damper 48, extending forwardly through the wall of the fixed tubular section 32 toward the front of the fireplace. The handle 50 terminates in a right-angle bent portion 52 which facilitates the turning of the handle to effect the rotation of the damper.

The damper 48 may be selectively rotated by means of the handle 50 to assume positions intermediate the fully open position (horizontal) and the fully closed position (vertical) so as to adjust the volume of air flowing into the air jet portion 30, thereby regulating the draft on the combustion area provided by the air jet outlet opening 36. FIGS. 3A, 3B and 3C illustrate the operation of the air flow controls in the air jet portion 30. FIG. 3A shows the damper 48 in a closed position thereby blocking off any air flow to the rotating center section 34 so that no air escapes through the air jet passage 36. Thus, with the damper 48 closed, all the air introduced into the entrance opening 16 will flow through the heat absorbing portisns of the air conducting conduit 12. The damper 48 would be closed in those situations where it would be desirable to have no air flowing through the air jet passage 36. For example, it may be found that once the fuel is ignited there is present sufficient natural draft to sustain the combustion without the need for augmentation of the air flow to the fuel. Also, shutting off the air flow through the air jet passage 36 will facilitate damping or suffocating the flames when desired. In addition, it may be found that in those fireplaces which use a gas jet flame there may be no need to induce an artificial draft.

FIG. 3B shows the damper 48 in its fully open position allowing air to flow from the air passage 14 in the air conducting conduit leg 20 into the air jet portion 30. As shown in FIG. 3B, the rotating center section 34 of the air jet portion 30 has been turned so that the air jet opening 36 is pointing directly towards the rear of the unit. Inasmuch as the fuel would normally be placed in the area between the air jet portion 30 and the rear transverse air conduit leg 24, the orientation of the air jet opening 36 shown in FIG. 3B would be that which is normally used for directing a draft of air onto the fuel. For example, directing the air draft directly rearward or perhaps slightly downward from a straight rearward orientation would be most advantageous where the fuel used in the fireplace is coal or relatively small amounts of wood. However, when a relatively large amount of fuel is used, as in the case of one or more relatively large logs, it may be most advantageous to turn the rotating central section 34 so as to direct the air jet opening 36 rearwardly and upwardly as shown in FIG. 3C. This orientation of the air jet opening 36 may also be used where it is desired to direct the flame from a gas jet fireplace over a decorative ceramic log as will be presently described.

The air flow through the heating unit is illustrated by the bold arrows in FIG. 1. Air is propelled by suitable air moving means such as a squirrel cage blower 54 (shown in FIGS. 4, 8, 9 and 10) into the entrance opening 16 of the air conducting conduit 12. The air flows first through the first rearwardly extending longitudinal leg 20 from which a portion of the air may be diverted into the air jet section 30 if the damper 48 is open. The air then flows through the transverse leg 24, then through the forwardly extending longitudinal leg 22 and finally out into the room through the exit opening 18. Thus, the air conducting system is such that no opposing air flow forces are created. Therefore, the possibility of areas of air stagnation is eliminated.

Figure 5:
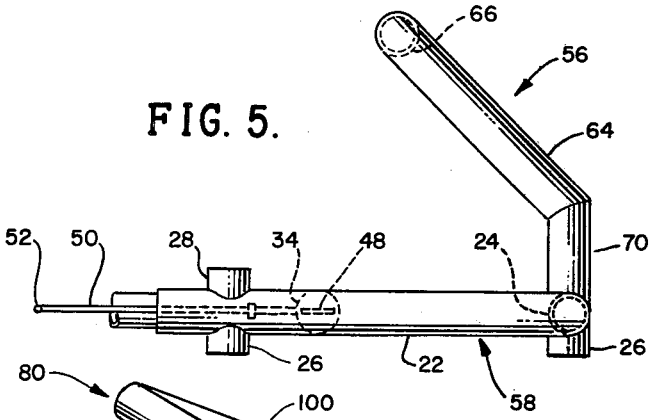
FIG. 5 is a side elevation view of the preferred embodiment of the invention.

The embodiment illustrated in FIGS. 4 and 5, which is the preferred embodiment, includes all of the structural features of the embodiment shown in FIG. 1, and in addition an upper heat absorbing portion 56. Legs 20, 22 and 24 of the air-conducting conduit 12 now form a lower heat absorbing portion 58, which retains its function as a grate, and therefore may be described as a grate portion.

The upper heat absorbing portion 56 of the air-conducting conduit 12 is in air-flow communication with the lower heat absorbing portion 58 and is likewise formed of hollow tubular members. The upper heat absorbing portion 56 is composed of a rear transverse leg 60 which is located a distance directly above the lower heat absorbing portion or grate portion transverse leg 24. Extending forwardly and at an upward angle of between approximately 30 and 60 degrees from the ends of the rear transverse leg 60 and in fluid communication therewith is a pair of parallel tubular leg elements 62 and 64. At their forward extremities, the legs 62 and 64 are connected to and are in fluid communication with the ends of a front transverse leg 66 which is parallel to the rear transverse leg 60. The upper heat absorbing portion 56 is connected to and in communication with the lower heat absorbing portion 58 by means of a pair of short vertical hollow tubular sections 68 and 70. The vertical section 68 extends upwardly from the juncture of the lower legs 20 and 24 to the juncture of the upper legs 60 and 62, while the vertical section 70 extends upwardly from the juncture of the lower legs 22 and 24 to the juncture of the upper legs 60 and 64.

The flow of air through the air conducting conduit 12 of the preferred embodiment is shown by the bold arrows in FIG. 4. Air from the squirrel cage blower 54 is blown through a flexible tubing 72 into the entrance opening 16. From there, the air that is not diverted into the air jet section 30 travels through the leg 20 until it reaches the juncture of the legs 20 and 24 and the vertical section 68. At this point the air stream is split into two parts, with one part of the air stream continuing its flow through the lower heat absorbing portion transverse leg 24 and the other part of the stream flowing upwardly through the vertical section 68 into the upper heat absorbing portion 56 at the juncture of the legs 60 and 62. At this point the air stream is once again divided with one part going through the legs 62, 66 and 64 and the other part flowing through the leg 60. The latter two streams then converge at the juncture of the legs 60 and 64 and the vertical section 70, flowing down the vertical section 70, where they converge with the portion of the air flow that has flowed through the lower portion transverse leg 24. The entirely reunited air stream then flows through the forwardly extending leg 22 and out into the room through the exit opening 18. Again, in this embodiment as in the first, there are no areas of air stagnation due to the lack of opposing air flow forces.

Figure 6:
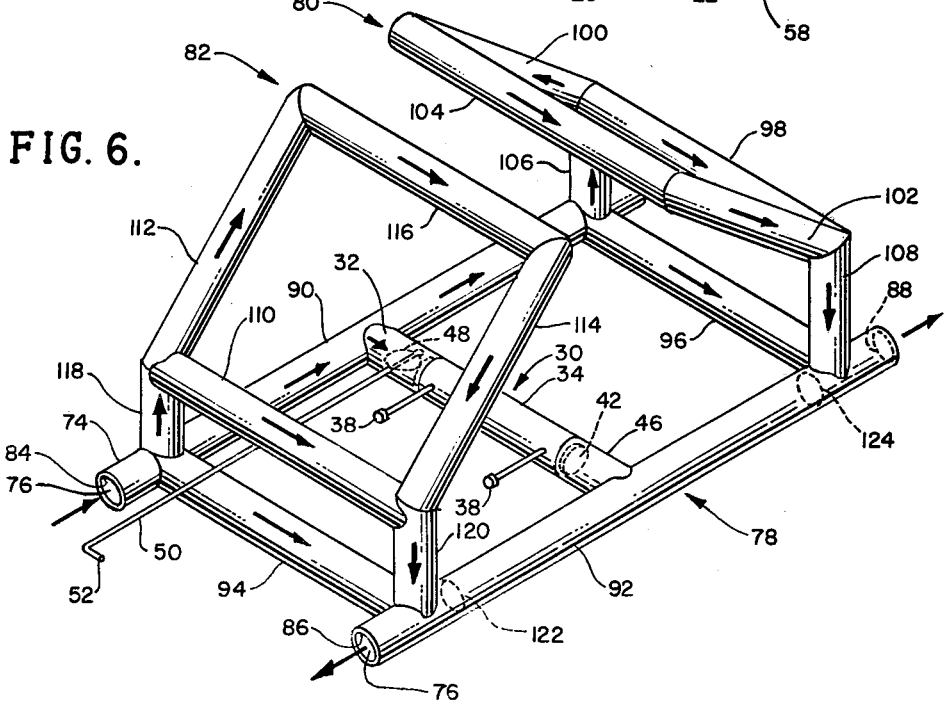
FIG. 6 is a top perspective view of another embodiment of the invention which is suitable for use in a double fireplace.
Figure 7:
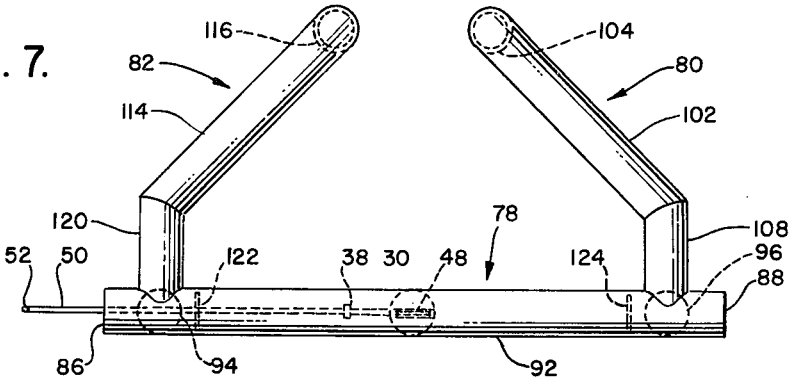
FIG. 7 is a side elevation view of the embodiment shown in FIG. 6.

A particular advantage of the preferred embodiment is that the upper heat absorbing portion 56 is located in the area of the fireplace having the greatest concentration of heat, namely, the area of rising hot air immediately above the flame. This structure thus gives the preferred embodiment a high degree of efficiency in transferring heat from the fireplace to the air in the air conducting conduit 12 which ultimately flows into the room or into a device in which the heat may be put to practical use, as will be presently described The embodiment illustrated in FIGS. 6 and 7 is specifically designed for use in fireplaces commonly known as double fireplaces which communicate with two adjoining rooms. This embodiment may be simply described as essentially two units constructed in accordance with the preferred embodiment of FIGS. 4 and 5, conjoined so as to face one another, and sharing a single common air jet section 30. More specifically, this embodiment, like the previous embodiments, is comprised of an air conducting conduit 74, the interior wall of which forms an air passage 76. The conduit 74 forms a grate or lower heat absorbing portion 78, a rear upper head absorbing portion 80, and a front upper heat absorbing portion 82 which is the mirror immage of the rear upper heat absorbing portion 80. As in the previous embodiment, the conduit 74 has an entrance opening 84 and an exit opening 86 which are opened to the room at the front of the fireplace. In addition, this embodiment has a second exit or outlet opening 88 located catercorner to the entrance opening and directing air out in an opposite direction to the air leaving the first exit or outlet opening 86.

The grate or lower heat absorbing portion 78 comprises a first longitudinal leg 90 extending from the entrance opening 84 rearwardly through the fireplace along one side thereof; a second longitudinal leg 92 which is displaced from and parallel to the first longitudinal leg 90 along the other side of the fireplace, and which has open ends forming the exit openings 86 and 88; and front and rear transverse legs 94 and 96 respectively which connect the longitudinal sections 90 and 92 proximate the front and rear respectively of the fireplace. An air jet section 30 identical in construction to that shown in conjunction with the previous embodiments is disposed between the longitudinal legs 90 and 92 proximate the middle of the fireplace.

The upper heat absorbing portions 80 and 82 of the air conducting conduit 74 are similar in construction to the upper heat absorbing portion 56 of the embodiment illustrated in FIGS. 4 and 5. The rear upper heat absorbing portion 80 comprises a lower transverse section 98, the ends of which are attached to and communicate with a pair of parallel upwardly and forwardly extending legs 100 and 102. The upper ends of the legs 100 and 102 are connected to and are in communication with an upper transverse leg 104 which is parallel to the lower transverse leg 98. As in the embodiment illustrated in FIGS. 4 and 5, the rear upper heat absorbing portion 80 is connected to and in air-flow communication with the lower heat absorbing portion by means of a pair of vertical hollow tubular sections 106 and 108. The vertical section 106 extends upwardly from the juncture of the base portion legs 90 and 96 to the juncture of the upper heat absorbing portion legs 98 and 100 while the vertical section 108 extends upwardly from the juncture of the base portion legs 92 and 96 to the juncture of the upper heat absorbing portion legs 98 and 102.

As mentioned previously, the front upper heat absorbing portion 82 is the mirror image of the rear heat absorbing portion 80. Thus, it consists of a lower transverse leg 110 displaced above and parallel to the base portion front transverse leg 94. The ends of the transverse leg 110 are connected to and in communication with the lower ends of a pair of parallel upwardly and rearwardly extending legs 112 and 114. The upper ends of the legs 112 and 114 are connected to and in communication with the ends of an upper transverse leg 116. The front upper heat absorbing portion 82 is connected to and in air-flow communication with the grate portion 78 by means of a pair of short vertical hollow tubular sections 118 and 120. The vertical section 118 extends upwardly from the juncture of the lower heat absorbing portion legs 90 and 94 to the juncture of the front upper heat absorbing portion legs 112 and 110 while the vertical section 120 extends upwardly from the junction of the lower heat absorbing portion legs 94 and 92 to the juncture of the front upper heat absorbing portion legs 110 and 114. The air flow through the double fireplace embodiment is shown by the bold arrows. Air entering the entrance opening 84 divides into three streams at the juncture of the grate portion legs 90, 94 and the vertical section 118. One stream is diverted through the vertical section 118 into the front upper heat absorbing portion 82; another stream flows through the grate portion transverse leg 94; and the third stream continues through the grate portion longitudinal leg 90. The stream flowing into the front upper heat absorbing section 82 is again divided into two more streams at the juncture of the legs 110, 112 and 118 with one of these later two streams flowing the legs 112, 116 and 114 and the other flowing through the leg 110. The latter two streams converge at the juncture of the legs 110, 114 and 120 and flows down to section 120 to meet the flow arriving through the leg 94 at the juncture of the legs 94 and 92 from which point the reunited stream of air flows out the front exit opening 86.

As just previously mentioned, a portion of the stream of air entering the entrance opening 84 continues through the grate portion longitudinal leg 90. Some of this latter stream may be diverted, if the damper 48 is open, into the air jet portion 30. The remaining air continues its flow through the leg 90 to the juncture of the legs 90 and 96 and the short vertical section 106. At this point, the stream is divided into two parts with one part flowing through the grate portion rear transverse leg 96 and the other part flowing up the vertical sectin 106 and then into the rear upper heat absorbing portion 80 through which the air circulates in the same manner as previously described with respect to the front upper heat absorbing portion 82. The two streams which were divided at the juncture of the legs 90, 96 and 106 are reunited at the juncture of the legs 96, 92 and 108 from which point the reunited stream flows out the rear exit opening 88.

As can be appreciated from the above description and the accompanying FIG. 6, this embodiment once again displays a lack of opposing air flow with the result that there are no areas of air stagnation within the heating unit. In furtherance of this end, a pair of partions 122 and 124 are located in the grate portion longitudinal leg 92 just rearwardly of the front vertical section 120 and just forwardly of the rear vertical section 108 respectively. The partitions 122 and 124 block the air passage 76 through the base portion longitudinal leg 92 so that the air stream flowing through the front portion of the unit cannot oppose the air stream flowing through the rear portion of the unit within the leg 92.

Figure 8:
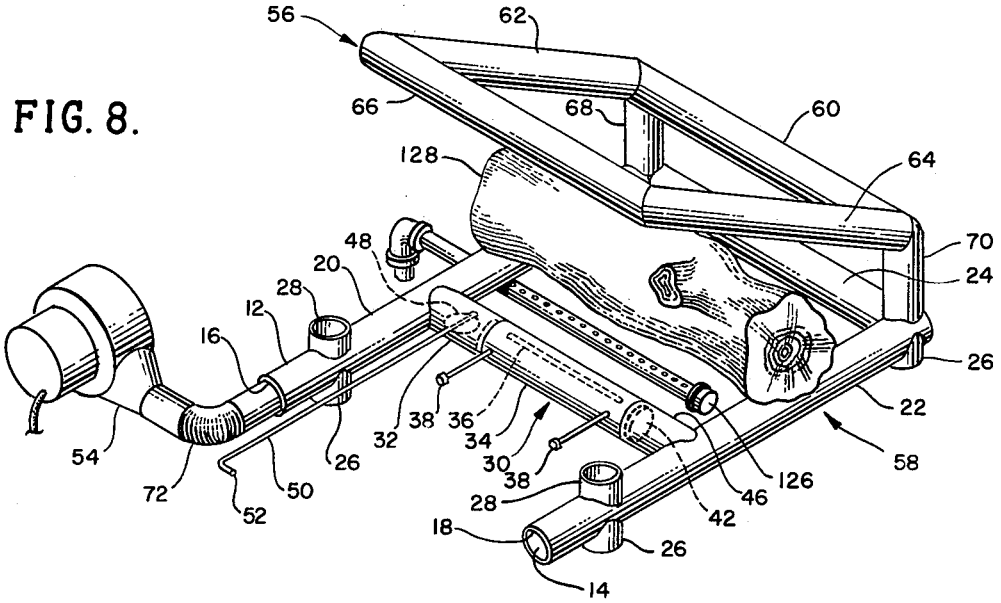
FIG. 8 is a top perspective view of the preferred embodiment of the invention showing its use in a gas jet fireplace.

FIG. 8 shows the preferred embodiment of the invention as it is used in a fireplace utilizing a flame provided by a gas jet 126. Often placed in such fireplaces is a ceramic log 128 which, while it does not itself burn, gives the appearance of burning when it is surrounded by a flame from the gas jet 126. When the heating unit is used in such a fireplace, it is not necessary to induce an artificial draft onto the plane from the air jet opening 36 in the air jet portion 30. Thus, the damper 48 may be conveniently kept closed to provide the maximum amount of air flowing through the heat absorbing portions of the air conducting conduit 12, thereby achieving maximum heating efficiency. However, for aesthetic purposes, it may be desirable to blow the flame over the ceramic log 128 so as to enhance the illusion of a burning log in the fireplace. To achieve this effect, the damper 48 may be open and the center section 34 of the air jet portion 30 rotated so as to point the air jet opening 36 upwardly and rearwardly as most clearly shown in FIG. 3C, thereby causing the air stream flowing from the air jet opening 36 to blow the flame from the gas jet 126 around and over the top of the ceramic log 128, resulting in the illusion that the log is itself burning.

The embodiment shown in FIG. 8 is especially convenient for use in fireplaces in which natural gas is only one of the fuels that may be used. In such a fireplace, of course, fuel such as wooden logs and coal may be conveniently used together with or in place of the gas jet 126 as a source of flame. If such other fuel is used, the air flow controls (the damper 48 and the rotating center section 34) in the air jet portion 30 can be manipulated as previously described properly to control the flow of air on the fuel.

Figure 9:
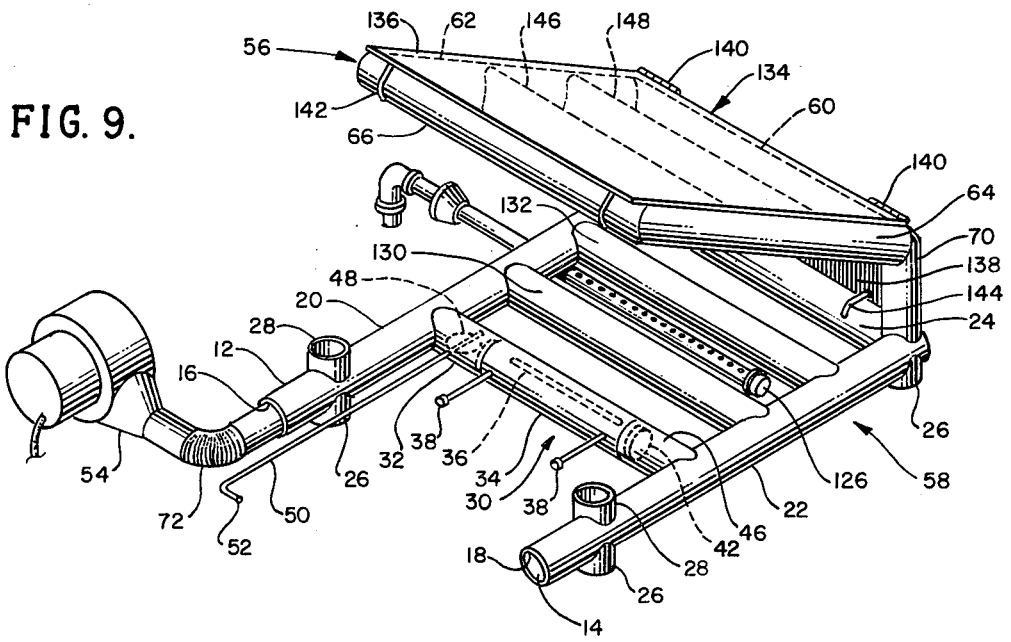
FIG. 9 is a top perspective view of an alternative embodiment of the invention showing additional adaptations for use in a gas jet fireplace.

FIG. 9 shows a modification of the preferred embodiment of the invention which is designed to make more effective use of the radiant transfer of heat. This configuration also envisions the use of the gas jet 126 located slightly below the heating unit and traversing the interior of the fireplace at a location approximately midway between the lower portion rear transverse leg 24 and the air jet portion 30 as in the embodiment shown in FIG. 8. However, this configuration also includes a pair of parallel transverse heat absorbing legs 130 and 132 connected to and in communication with the longitudinal legs 20 and 22 immediately to the front and the rear respectively of the gas jet 126. This configuration also includes a radiant reflector shield 134 comprising an upper section 136 and a lower section 138 pivotally attached to one another by means of a pair of hinges 140. The radiant heat reflector shield 134 may be conveniently formed of sheet steel or aluminum, preferably about one-eighth inch thick. The upper portion 136 of the heat reflecting shield 134 covers the top surfaces of the legs 60, 62, 64 and 66 of the upper heat absorbing portion 56 while the rear section 138 of the shield 134 covers the rear surfaces of the upper heat absorbing portion rear transverse leg 60 and the lower heat absorbing portion rear transverse leg 124. The shield 134 is removably attached to the heating unit by means of a first pair of hooks 142 which append from the forward edge of the upper shield section 136 and which engage the upper heat absorbing section front transverse leg 66, and by a second pair of hooks 144 which append from the lower edge of the rear shield section 138, engaging the lower heat absorbing portion rear transverse leg 124.

As previously mentioned, the configuration shown in FIG. 9 has the advantage of making more effective use of the radiant heat of the flame. This is accomplished by the shield 134 which reflects the heat of the flame downwardly and forwardly so as to impinge upon the transverse heat absorbing legs 130 and 132 in the lower heat absorbing portion 58. Also, a significant portion of the heat from the flame is reflected by the shield 134 directly into the room. This effect may be enhanced by manipulating the air flow controls of the air jet section 30 so as to direct the flame towards the heat reflecting shield 134. When ceramic logs are used in conjunction with a gas jet flame, the direction of the flame in this manner will also provide the previously mentioned illusion of a burning log.

This configuration also envisions the possible incorporation of additional transverse heat absorbing legs 146 and 148 in the upper heat absorbing portion 56.

Figure 10:
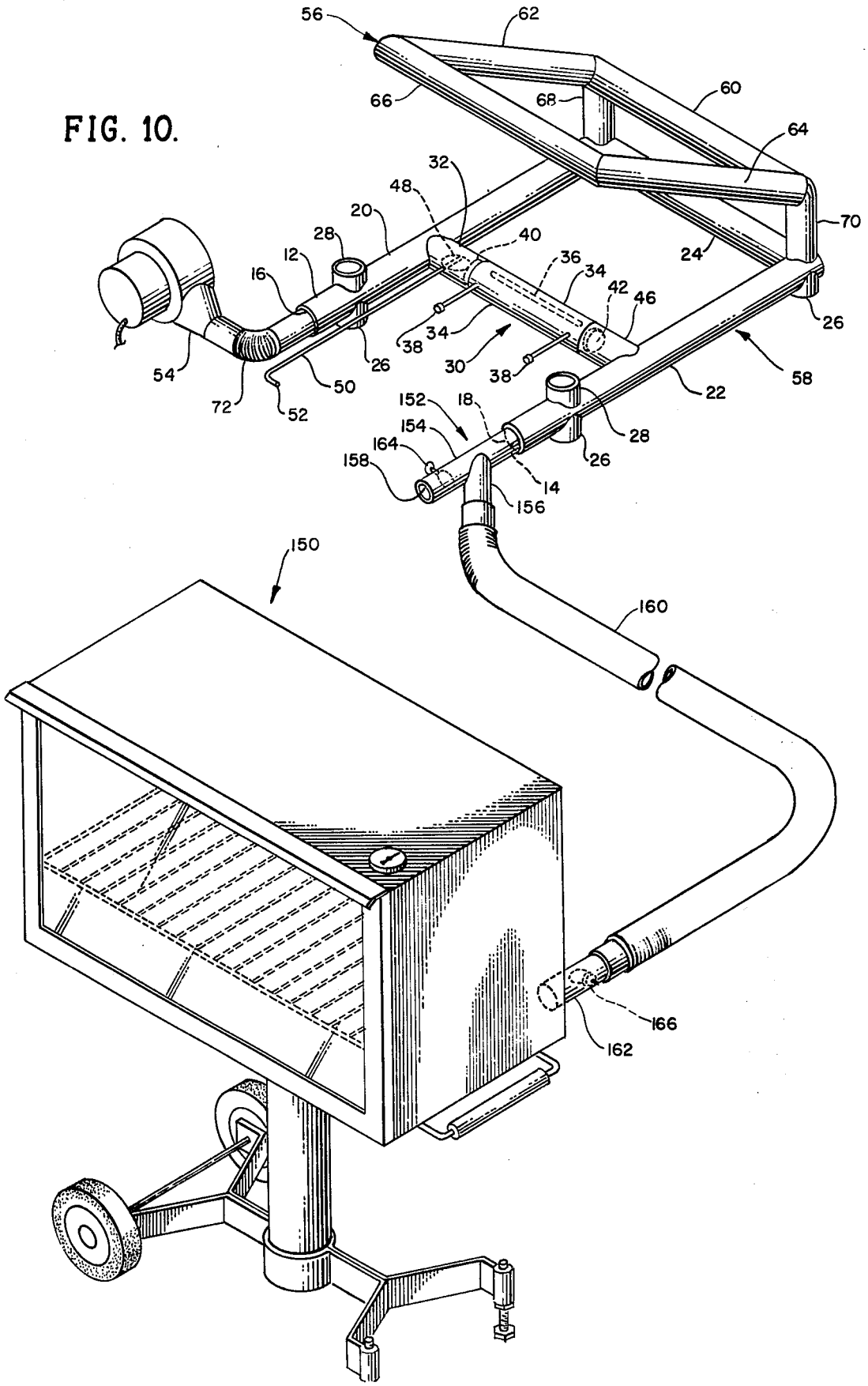
FIG. 10 is a top perspective view of the preferred embodiment invention showing its use as a source of heat for a portable oven.

FIG. 10 shows the preferred embodiment of the invention used as a source of heat for a portable oven 150. In this configuration, a hollow tubular Y-shaped extension 152 is fitted into the exit opening 18. The Y-shaped extension 152 comprises a straight forwardly extending tubular section 154 and a second tubular section 156 which branches off at an angle from the straight tubular section 154. The straight section 154 opens out into the room at the front of the fireplace to an exit or outlet opening 158. The branch section 156 opens into a flexible hose 160 which is connected to and in communication with an air inlet pipe 162 which empties into the interior of the oven 150.

In order to direct the heated air from the heating unit into the oven, the exit or outlet opening 158 is shut by means of a damper valve 164 which is located in the straight section 154 of the tubular extension 152 between the outlet opening 158 and the juncture of the branch sectin 156. Heated air will then flow out of the heating unit through the exit opening 18 and into the tubular extension 152 where it will enter the branched section 156, flowing into the hose 160 and then into the oven 150 through the inlet pipe 162. In order to regulate the flow of air into the oven, it is advantageous to provide a second damper valve 166 in the oven inlet pipe 162. Since the air entering the oven exceeds 250° F., the cooking of many different types of foods can be accomplished using heat from the fireplace that would have been waisted without the use of the heating unit. Thus, the cooking function can be accomplished without the comsumption of any more fuel then would be used to provide heat for the room. Because of the high temperatures involved, it is of course necessary that the flexible hose 160 be made of a heat resistent material.

Although the invention has been shown as a source of heat for an oven, it is of course understood that the invention can be used in conjunction with many other household appliances, such as, for example, a clothes dryer, which require a source of heat.

The invention herein may be made of any material that is capable of withstanding extremely high temperatures and the stress and strain of being subjected to the heat of a fire. The air conduit members are preferably made of cold-rolled steel pipe having a wall thickness of approximately one-eighth inch. The pipe may be cut to the desired length and shaped and welded together. It is preferred that all turns and intersections be square or perpendicular in order to minimize air friction within the system. The air moving means may be a blower, fan, or squirrel cage blower. The squirrel cage blower as shown is preferred. The squirrel cage blower can be directly coupled to the entrance opening 16 or it can be coupled through a flexible hose as shown in the drawings. In permanent or semi-permanent installation, an entrance pipe leading to the blower may be extended to the outside of the home, thus providing a fresh air supply.

What is claimed is:

1. A fireplace heater, comprising:

a first plurality of interconnecting, hollow, tubular, air-conducting, heat-absorbing legs forming a fireplace grate portion, and having an air inlet and an air outlet;

a second plurality of interconnecting, hollow, tubular, air-conducting, heat absorbing legs in communication with said first plurality and disposed over said grate portion, and forming an upper heat-absorbing portion, the legs in said grate portion and said upper heat absorbing portion being interconnected so as substantially to eliminate opposing flows of air as the air travels from said inlet through said grate portion, through said upper heat-absorbing portion and finally out of said outlet;

air moving means for propelling air through said first and second pluralities of air conducting tubular legs from said inlet to said outlet;

air jet means in communication with one of said legs for directing a jet of air onto a flame in said fireplace;

valving means for controlling the flow of air into said air jet means; and air jet control means, integral with said air jet means, for controlling the direction of said jet of air.

2. The fireplace heater of claim 1, wherein said air jet means is in communication with one of said first plurality of hollow, tubular, heat absorbing, air conducting legs.

3. A fireplace heater, as defined in claim 1 wherein said second plurality of heat-absorbing legs forms a first upper heat-absorbing portion at one end of said grate portion, said grate portion having an air inlet and a first air outlet at one end thereof, and further comprising:

a third plurality of hollow tubular legs in communication with said first plurality and forming a second upper heat absorbing portion at the opposite end of said grate portion from said second plurality of legs; and a second air outlet in said grate portion catercorner from said air inlet.

4. A fireplace heater as defined in claim 3 wherein said first and second air outlets are at opposite ends of one of said first plurality of legs comprising said grate portion.

5. A fireplace heater, as defined in claim 4 further comprising partition means in said one of said first plurality of legs having said first and second air outlets for substantially preventing the air flowing through said first upper heat absorbing portion to oppose the flow of air flowing through said second upper heat absorbing portion within said one of said first plurality of legs having said first and second air outlets.

6. A fireplace heater, as defined in claim 1, further comprising heat reflecting means on said upper heat-absorbing portion for reflecting heat from said flame onto said first plurality of heat-absorbing legs.

7. A fireplace heater, comprising: a continuous heat-absorbing air conduit, comprising:

(a) first and second hollow tubular leg members each having an inlet and an outlet, said inlet of said first leg member receiving air into said fireplace heater and said outlet of said second leg member expelling air from said fireplace heater;

(b) a third hollow tubular leg member interconnecting said first and second leg members, having an inlet in communication with said first leg member essentially at the outlet of said first leg member and an outlet in communication with said second leg member essentially at the inlet of said second leg member;

(c) said first, second and third leg members of said heat-absorbing air conduit defining generally a fireplace grate with said inlet of said first leg member and said outlet of said second leg member at one end of said grate;

(d) first and second upright hollow tubular sections each having an inlet and outlet, said inlet of said first upright section in communication with said fireplace grate essentially at the juncture of said first and third leg members, and the outlet of said second upright section in communication with said fireplace grate near the juncture of said second and third leg members;

(e) first and second upper heat-absorbing hollow tubular leg members each having an inlet and an outlet, said inlet of said first upper heat-absorbing leg member and said outlet of said second upper heat-absorbing leg member in respective communication with said first and second upright sections essentially at the outlet of said first upright section and the inlet of said second upright section;

(f) third and fourth upper heat-absorbing hollow tubular leg members interconnecting said first and second upper heat-absorbing leg members; and each having an inlet and an outlet, said inlet and outlet of said third upper heat-absorbing let member in respective communication with said first and second upper heat-absorbing leg members essentially at the outlet of said first upper heat-absorbing leg member and the inlet of said second upper heat-absorbing leg member respectively, and said inlet and outlet of said fourth upper heat-absorbing in respective communication with said first and second upper heat-absorbing leg members essentially at said inlet of said first upper heat-absorbing leg member and said outlet of said second upper heat-absorbing leg member;

(g) said first, second, third and fourth upper heat-absorbing leg members defining a plane located generally above said fireplace grate and supported by said first and second upright sections;

air moving means in communication with said inlet of said first heat-absorbing leg member for the circulation of air through said fireplace heater;

air jet means, interconnecting said first and second heat-absorbing leg members, having an inlet in communication with said first heat-absorbing leg member and an outlet proximate the area of said fireplace in which fuel is burned, for directing a jet of air into said area;

valving means at said inlet of said air jet means for regulating the amount of air flowing into said air jet means from said first heat-absorbing leg member; and means for changing the vertical angular orientation of said outlet of said air jet means.

8. A fireplace heater, as defined in claim 7 wherein said fireplace grate is supported by a plurality of supports attached to said grate and additionally comprises means for fireplace fuel retention.

9. A fireplace heater, as defined in claim 7 wherein the plane formed by said first, second, third and fourth upper heat-absorbing leg members intersects at an angle the plane formed by said fireplace grate.

10. A fireplace heater, as defined in claim 7 wherein said second heat absorbing leg member has a first and a second outlet, said first outlet located at the same end of said grate as said inlet of said first heat-absorbing leg member and said second outlet located at the opposite end of said grate from said inlet of said first heat-absorbing leg member and catercorner thereto, so that said first outlet opens into a first room heated by said fireplace and said second outlet opens into a second room, adjoining said first room, and heated by said fireplace.

11. A fireplace heater, as defined in claim 10 wherein said heat-absorbing air conduit further comprises:

a fourth heat-absorbing hollow tubular leg member interconnecting said first and second heat-absorbing leg members, having an inlet in communication with said first leg member near said inlet of said first leg member and an outlet in communication with said second leg member near said first outlet of said second leg member, and defining generally a fireplace grate with said first, second, and third heat-absorbing leg members;

third and fourth upright hollow tubular sections each having an inlet and outlet, said inlet of said third upright section in communication with said fireplace grate essentially at the juncture of said first and fourth heat-absorbing leg members and the outlet of said fourth upright section in communication with said fireplace grate near the juncture of said second and fourth heat-absorbing leg members;

fifth and sixth upper heat-absorbing hollow tubular leg members each having an inlet and an outlet, said inlet of said fifth upper heat-absorbing leg member and said outlet of said sixth upper heat-absorbing leg member in respective communication with said third and fourth upright sections essentially at the outlet of said third upright section and the inlet of said fourth upright section respectively; and seventh and eighth upper heat-absorbing hollow tubular leg members interconnecting said fifth and sixth upper heat-absorbing leg members and each having an inlet and an outlet, said inlet and outlet of said seventh upper heat-absorbing leg member in respective communication with said fifth and sixth upper heat-absorbing leg members essentially at the outlet of said fifth upper leg member and the inlet of said sixth upper leg member respectively, said inlet and outlet of said eighth upper leg member in respective communication with said fifth and sixth upper leg members essentially at said inlet of said fifth upper leg member and said outlet of said sixth upper leg member, said fifth, sixth, seventh, and eighth upper heat-absorbing leg members defining a plane located generally above said fireplace grate at the opposite end thereof from the plane defined by said first, second, third and fourth upper heat-absorbing leg members, and supported by said third and fourth upright sections.

12. A fireplace heater, as defined in claim 7, further comprising:

a heat-reflecting shield attachable to at least one of said first, second, third and fourth upper heat-absorbing leg members so as to overlie a substantial portion of said fireplcace grate.

13. A fireplace heater, comprising:

a first plurality of interconnected air conduit members forming a fireplace grate, each of said air conduit members having an inlet and an outlet;

a second plurality of interconnected air conduit members disposed over said fireplace grate, each of said second plurality of conduit members having an inlet and an outlet;

a third plurality of air conduit members connecting said first and second pluralities of air conduit members to form a heater system, each member of said third plurality of air conduit members having an inlet and an outlet;

at least one of said inlets in said first plurality forming an entrance opening to said heater system, and at least one of said outlets in said first plurality forming an exit opening from said heater system;

each of the remainder of said inlets being connected to the outlet of another air conduit member, and each of the remainder of said outlets being connected to the inlet of another air conduit member;

air moving means in communication with said entrance opening of said heater system for the circulation of air from said entrance opening through each of said conduit members to the exit opening of said heater system, without counter flow;

air jet means, having an inlet in communication with at least one of said air conduit members, for directing a draft of air from said heater system into the area of said fireplace wherein fuel is burned;

valving means at said inlet of said air jet means for regulating the amount of air flowing into said air jet means; and means for controlling the direction of said draft of air from said air jet means.

14. A fireplace heater, as defined in claim 13 wherein said air jet means is a hollow tubular member having an outlet portion proximate said area of said fireplace wherein fuel is burned, and said means for controlling the direction of said draft of air comprises means for rotating said outlet portion.

15. A fireplace heater, as defined in claim 13 further comprising:

heat-reflecting means, attachable to said second plurality of air conduit members, for reflecting rising heat from a flame in said fireplace onto said fireplace grate.

16. A heat source for a household appliance, comprising:

a fireplace for burning fuel to produce a flame;

a first plurality of interconnected air conduit members forming a grate in said fireplace and including a pair of longitudinal air conduit members extending from the front to the rear of said fireplace, each of said first plurality of air conduit members having at least one inlet and at least one outlet;

a second plurality of interconnected air conduit members disposed over said grate, each of said second plurality of air conduit members having at least one inlet and at least one outlet;

a third plurality of air conduit members connecting said first and second pluralities of air conduit members to form a heater system, each of said third plurality of air conduit members having at least one inlet and at least one outlet;

an inlet to one of said pair of longitudinal air conduit members forming an entrance to said heater system and an outlet from the other of said pair of longitudinal air conduit members forming an exit from said heater system;

each of the remainder of said inlets being connected to an outlet of another air conduit member, and each of the remainder of said outlets being connected to an inlet of another air conduit member, air moving means in communication with said entrance of said heater system for the circulation of air from said entrance through each of said air conduit members to said exit, without counterflow;

said first, second and third pluralities forming means for transferring heat from said flame to said air circulating through said air conduit members; and outlet conduit means in communication with said exit for directing heated air from said exit into said appliance.

17. A fireplace heater, for a fireplace serving two adjoining rooms, comprising:

a first plurality of interconnected air conduit members forming a fireplace grate including a pair of longitudinal air conduit members extending through the inside of said fireplace along the sides thereof, each of said conduit members having at least one inlet and at least one outlet, and each of said pair of longitudinal air conduits having at least two outlets;

a second plurality of interconnected air conduit members disposed over one end of said fireplace grate, each of said second plurality of conduit members having at least one inlet and at least one outlet;

a third plurality of interconnected air conduit members disposed over the end of said fireplace grate opposite said second plurality, each of said third plurality of conduit members having at least one inlet and one outlet;

a fourth plurality of air conduit members connecting said first and second pluralities, each member in said fourth plurality having at least one inlet and at least one outlet;

a fifth plurality of air conduit members connecting said first and third pluralities to form a heater system with said first, second, third, and fourth pluralities, each member in said fifth plurality having at least one inlet and at least one outlet;

at least two of said outlets of one of said pair of longitudinal air conduit members forming a pair of exits from said heater system and an inlet to the other of said pair of longitudinal air conduit members forming an entrance to said heater system, said entrance and one of said pair of exits opening into one of said two adjoining rooms and the other of said pair of exits opening into the other of said two adjoining rooms;

each of the remainder of said inlets being connected to an outlet of another conduit member, and each of the remainder of said outlets being connected to an inlet of another condit member; and air moving means in communication with said entrance of said heater system for the circulation of air from said entrance through each of said conduits to said exits of said heater system, without counterflow.

18. A fireplace heater, as defined in claim 17 further comprising:

air jet means, having an inlet in communication with one of said air conduit members and an outlet proximate the area of said fireplace in which fuel is burned, for diverting a portion of air from said air conduit member to provide a jet of air into said area of said fireplace;

valving means at said inlet of said air jet means for controlling the amount of air diverted into said air jet means; and means for adjusting the direction of said jet of air.

19. An apparatus for cooking food, comprising:

a fireplace for burning fuel to produce a flame;

a first plurality of interconnected air conduit members forming a grate in said fireplace and including a pair of longitudinal air conduit members extending from the front to the rear of said fireplace, each of said first plurality of air conduit members having at least one inlet and at least one outlet;

a second plurality of interconnected air conduit members disposed over said grate, each of said second plurality of air conduit members having at least one inlet and at least one outlet;

a third plurality of air conduit members connecting said first and second pluralities of air conduit members to form a heater system, each of said third plurality of air conduit members having at least one inlet and at least one outlet;

an inlet to one of said pair of longitudinal air conduit members forming an entrance to said heater system and an outlet from the other of said pair of longitudinal air conduit members forming an exit from said heater system;

each of the remainder of said inlets being connected to an outlet of another air conduit member, and each of the remainder of said outlets being connected to an inlet of another air conduit member;

air moving means in communication with said entrance of said heater system for the circulation of air from said entrance through each of said air conduit members to said exit, without counterflow;

said first, second, and third pluralities forming means for transferring heat from said flame to said air circulating through said air conduit members;

an oven in which said food is placed to be cooked; and outlet conduit means, in communication with said exit and said oven, for directing heated air from said exit into said oven.

20. The apparatus defined in claim 19, wherein said outlet conduit means comprises a "Y" shaped hollow tubular member having a first branch and a second branch, said first directing said heated air from said exit into a room, and said second branch directing said heated air from said exit into said oven.

21. The apparatus defined in claim 19 further comprising:

outlet valving means in said outlet conduit means for adjusting the amount of air flowing from said exit opening into said oven.

22. The apparatus defined in claim 19, further comprising:

air jet means, having an inlet in communication with one of said air conduit members and an outlet proximate the area of said fireplace in which said fuel is burned for providing a jet of air into said area of said fireplace;

valving means for controlling the amount of air entering said inlet in said air jet means; and means for adjusting the direction of said jet of air.

* * * * *